US009417006B2

(12) United States Patent
Shen

(10) Patent No.: US 9,417,006 B2
(45) Date of Patent: Aug. 16, 2016

(54) FRAME AND REFRIGERATING APPARATUS

(71) Applicant: Carrier Corporation, Farmington, CT (US)

(72) Inventor: Nathan (Jiarun) Shen, Shanghai (CN)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 14/417,885

(22) PCT Filed: Jul. 19, 2013

(86) PCT No.: PCT/IB2013/001586
§ 371 (c)(1),
(2) Date: Jan. 28, 2015

(87) PCT Pub. No.: WO2014/020394
PCT Pub. Date: Feb. 6, 2014

(65) Prior Publication Data

US 2015/0153098 A1 Jun. 4, 2015

(30) Foreign Application Priority Data

Aug. 2, 2012 (CN) ..... 2012 1 0272927

(51) Int. Cl.
*F25D 23/06* (2006.01)
*F25D 21/04* (2006.01)
*F25D 11/00* (2006.01)

(52) U.S. Cl.
CPC ..... *F25D 23/063* (2013.01); *F25D 11/00* (2013.01); *F25D 21/04* (2013.01); *F25D 23/067* (2013.01); *F25D 2201/14* (2013.01)

(58) Field of Classification Search
CPC ..... F25D 23/063; F25D 23/062; F25D 21/04; F25D 23/067; F25D 23/065
USPC ..... 220/592.1, 592.09, 592.03, 592.02, 220/592.27, 592.25, 592.2; 62/447, 441, 62/457.1
See application file for complete search history.

(56) References Cited

U.S. PATENT DOCUMENTS 2,000,882 A * 5/1935 Comstock ..... F25D 23/062 220/592.26
2,238,022 A * 4/1941 Johnson ..... E04B 1/7612 220/592.05
2,753,695 A * 7/1956 Maranto ..... F25D 19/00 62/448

(Continued)

FOREIGN PATENT DOCUMENTS

CA 1031814 A1 5/1978
EP 0434225 A1 6/1991

(Continued)

OTHER PUBLICATIONS

International Search Report and Written Opinion for application PCT/IB2014/001586, dated Oct. 28, 2013, 11 pages.

(Continued)

*Primary Examiner* — Robert J Hicks
(74) *Attorney, Agent, or Firm* — Cantor Colburn LLP

(57) ABSTRACT

A frame and a refrigerating apparatus that uses the frame, the frame is composed by at least one frame component, wherein a vacuum insulation panel material is placed inside of the at least one frame component. The frame is capable of preventing the accumulation of water condensation along the frame, has both a better heat insulation effect and an energy-saving effect.

18 Claims, 3 Drawing Sheets

(56) References Cited

U.S. PATENT DOCUMENTS

| | | | | |
|---|---|---|---|---|
| 4,317,854 | A | 3/1982 | Rathmell | |
| 4,726,974 | A | 2/1988 | Nowobilski et al. | |
| 5,011,729 | A | 4/1991 | McAllister | |
| 5,424,118 | A * | 6/1995 | McLaughlin | E04B 1/6183 428/314.8 |
| 5,500,305 | A | 3/1996 | Bridges et al. | |
| 5,826,780 | A * | 10/1998 | Neeser | E04B 1/803 228/217 |
| 5,950,395 | A | 9/1999 | Takemasa et al. | |
| 6,119,422 | A | 9/2000 | Clear et al. | |
| 6,838,146 | B2 | 1/2005 | Merrill et al. | |
| 7,968,159 | B2 | 6/2011 | Feinerman | |
| 2008/0057288 | A1 | 3/2008 | Sironko et al. | |
| 2009/0179541 | A1 | 7/2009 | Smith et al. | |
| 2009/0186176 | A1 * | 7/2009 | Yamada | F16L 59/065 428/35.4 |
| 2011/0241513 | A1 | 10/2011 | Nomura | |
| 2012/0009376 | A1 | 1/2012 | Rusek, Jr. | |
| 2012/0031957 | A1 | 2/2012 | Whitaker et al. | |
| 2012/0231204 | A1 * | 9/2012 | Jeon | F16L 59/065 428/69 |

FOREIGN PATENT DOCUMENTS

| | | | | |
|---|---|---|---|---|
| EP | 2447639 | A2 | 5/2012 | |
| JP | H11166688 | A | 6/1999 | |
| WO | WO 2007041821 | A1 * | 4/2007 | C03C 25/42 |

OTHER PUBLICATIONS

Rose Bopla Enclosures, "GFK Fiberglass Mini Cabinet Enclosures Product Drawings", last updated Jul. 7, 2008, 3 pages.

* cited by examiner

FRAME AND REFRIGERATING APPARATUS

FIELD OF THE INVENTION

The invention involves a frame and a refrigerating apparatus that uses this frame. In particular, the invention is applicable to a refrigerating apparatus used for the refrigerating of food products (e.g. in supermarkets) and a corresponding frame.

BACKGROUND

A refrigerating apparatus structure in the prior art may generally comprise a main body, side panels, a frame and a door body; the side panels are installed on the two side ends of the main body, the frame is installed on the side of the main body that aligns with the outer edges of the door body, and the door body is installed in a manner directly facing towards the frame. A sealing strip is placed between the door body and the frame; the sealing strip may be placed upon the outer edges of the door body or upon the frame of the refrigerating apparatus.

Chinese Patent Application No. CN2009202118863.0 discloses an energy-saving refrigerator. The energy-saving refrigerator comprises a cabinet body, a foam interlayer filled inside the cabinet body and an insulation panel placed in the foam interlayer that is fixed in place with a supporting bracket; included among these, the insulation panel may be a vacuum insulation panel (hereon referred in short as VIP). However, since the VIP comprises a core and a coating layer surrounding the core, the direct placement of the VIP in the foam interlayer may cause the coating layer to break, the core of the VIP will absorb water resulting from this breakage. This damage to the VIP will greatly reduce the insulation effect of a refrigerator body's frame. Moreover, given that VIPs are widely used in the walls of energy-saving refrigerators, VIPs in walls of energy-saving refrigerators should be used to the greatest possible extent in efforts to reduce absorption of heat.

However, within the general structure in currently existing refrigerators, there exists a technical problem within the alignment on the front side of refrigerator of the refrigerator frame with the outside edges of the refrigerator's door body. In order to retrieve food from the inside of the refrigerator, the door body of refrigerator must be frequently opened; as a result, when warmer outside air encounters the cooler surface of refrigerator's frame, it rapidly cools down; this in turn forms water condensation. This condensation of water surmounts to great difficulty faced in the service and maintenance of a refrigerator.

For this reason, in currently existing refrigerator structures, the frame is installed with an electrical heating function that conducts heat by means of the available power supply. This electrical heating function is used to prevent evaporated water from condensing water along the frame. It is evident that the electrical energy consumed by this electrical heating function assumes a considerable portion of the total electrical energy consumed by the refrigerating apparatus. Furthermore, this electrical heating function is easily damaged and results in maintenance difficulty.

SUMMARY OF THE INVENTION

In resolving the technical problem, the invention provides a frame that prevents the formation of water condensation, and that simultaneously also has an advantageous energy-saving effect.

Furthermore, in resolving the technical problem, the invention provides a frame with vacuum insulation panel material placed inside of it that is easy to replace in the event of undergoing damage.

Furthermore, in resolving the technical problem, the invention provides a refrigerating apparatus with optimal ability in storing food products. Such an optimal refrigerating apparatus is to be installed with the aforementioned frame.

The invention will resolve the aforementioned technical problem and other possible technical problems by means of the following technical, planned solutions:

The invention's first aspect provides a frame used for a refrigerating apparatus, the frame is composed by at least one frame component, wherein a VIP material is placed inside of the at least one frame component.

Optionally, for the aforementioned frame, the VIP material is placed inside of the at least one frame component and adjacent the component's front surface.

Optionally, for the aforementioned frame, the at least one component comprises a component-body part and a component-cover part that is attached to the component-body part, the component-body part and the component-cover part together form a chamber for holding the VIP material.

Optionally, for the aforementioned frame, the component-body part and the component-cover part are attached together in a detachable manner.

Optionally, for the aforementioned frame, a foam heat-insulation material is further placed inside the at least one component.

Optionally, for the aforementioned frame, the foam heat-insulation material is placed inside of the at least one component and adjacent to the component's rear surface.

Optionally, for the aforementioned frame, the frame is formed as an opening to the refrigerating apparatus that is used for retrieving and placing items to be refrigerated.

The invention's second aspect provides a frame for refrigerating apparatus, the frame comprises an upper component, a lower component, a left component and a right component, among which, the upper component and the lower component are attached to the left component and the right component respectively so as to form a rectangular frame, wherein, at least one of the upper component, the lower component, the left component and the right component has a VIP material placed inside.

Optionally, for the aforementioned frame, the VIP material is placed inside of the at least one frame component and adjacent to the component's front surface.

Optionally, for the aforementioned frame, the at least one component comprises a component-body part and a component-cover part attached to the component-body part, the component-body part and the component-cover part together form a chamber for holding the VIP material Optionally, for the aforementioned frame, the component-body part and the component-cover part are attached together in a detachable manner.

Optionally, for the aforementioned frame, a foam heat-insulation material is further placed inside the at least one component.

Optionally, for the aforementioned frame, the foam heat-insulation material is placed inside of the at least one component and adjacent to the component's rear surface.

Optionally, for the aforementioned frame, the upper component, the lower component, the left component and the right component each comprises a component-body part and a component-cover part attached to the component-body part, the component-body part and the component-cover part together form a chamber for holding the VIP material.

Optionally, for the aforementioned frame, the component-body part and the component-cover part are attached together in a detachable manner.

Optionally, for the aforementioned frame, the foam heat-insulation material is further placed inside of the upper component, the lower component, the left component and the right component.

Optionally, for the aforementioned frame, the foam heat-insulation material is placed inside of the upper component, the lower component, the left component and the right component respectively and adjacent to the each component rear surface.

Optionally, for the aforementioned frame, the upper component, the lower component, the left component and the right component have the same structure.

Optionally, for the aforementioned frame, the upper component, the lower component, the left component and the right component are attached in a detachable manner by multiple attaching components in order to form the frame.

Optionally, for the aforementioned frame, the frame further comprises at least one intermediate component attached to the upper component and the lower component respectively or attached to the left component and the right component respectively.

Optionally, for the aforementioned frame, the at least one intermediate component is attached to the upper component and the lower component or attached to the left component and the right component in a detachable manner.

Optionally, for the aforementioned frame, a VIP material is placed inside of the at least one intermediate component.

Optionally, for the aforementioned frame, the VIP material is placed inside of the at least intermediate component and adjacent to component's front surface.

Optionally, for the aforementioned frame, the at least one intermediate component has the same structure as the upper component, the lower component, the left component and the right component.

Optionally, for the aforementioned frame, the frame forms an opening to the refrigerating apparatus that is used for retrieving and placing items to be refrigerated.

The invention's third aspect provides a frame for refrigerating apparatus, the frame comprises an upper component, a lower component, a left component, a right component and at least one intermediate component, the upper component and the lower component are attached to the left component and the right component respectively, the at least one intermediate component is attached to the upper component and the lower component respectively or attached to the left component and the right component respectively, wherein, at least one of the upper component, the lower component, the left component, right component and the at least one intermediate component has a VIP material placed inside.

Optionally, for the aforementioned frame, the frame forms an opening to the refrigerating apparatus that is used for retrieving and placing items to be refrigerated.

The invention's fourth aspect provides a refrigerating apparatus that used a frame of the preceding aspects.

Optionally, for the aforementioned refrigerating apparatus, the refrigerating apparatus comprises a main body and a door body, among which the frame is installed on the front side of the main body, and the door body is installed on the main body and can be rotated between an open position for opening the refrigerating apparatus and a closed position for closing the refrigerating apparatus in a manner that allows the door body to pivot back and forth.

The VIP material or vacuum insulation panel material according to the claims comprises a core and a coating layer surrounding the core. Particularly, the VIP material or vacuum insulation panel material according to the claims is a kind of vacuum heat preservation material that is formed by packaging glass wool core material characterized by extremely strong insulation characteristics together in a vacuum state with high barrier packaging material. The result exhibits excellent insulation characteristics. The VIP material can effectively avoid heat transfer caused by air convection, and the heat transfer coefficient can therefore be considerably reduced; moreover, the VIP material does not contain any ozone depleting material and has the characteristics of being environmentally protective, efficient and energy saving. Therefore, by means of installing VIP material inside of the at least one frame components, specifically near the front surface of the at least one component, the component will have well-defined heat insulation capability that has the following effect: under the condition that there is frequent opening and closing of the door body, when exterior warmer air makes contact with the front surface of the at least one frame component, condensed water will not be formed on the frame's front surface.

It is evident that that any reasonable combination of the above-described technical solutions also falls within the scope of protection for the invention.

BRIEF DESCRIPTION OF THE DRAWINGS

With reference to the accompanying drawings, the content of the invention's disclosure will become more easily understood. It is appreciated by those skilled in this technical domain that the accompanying drawings serve as examples only and are not intended to limit the scope of protection of the invention. In the drawings.

DETAILED DESCRIPTION OF THE INVENTION

FIGS. 1 to 5 and the following discussion disclose details about a particular implementation of the invention so as to teach those skilled in the technical domain how to produce the invention and use it in its best capacity. In order to present an overview of the invention, several conventional aspects have been simplified or omitted. Those skilled in the technical domain should understand that all variations originating from these particular examples also fall within the scope of the invention. Those skilled in the technical domain should understand that the features described below can be arranged in various ways so as to form numerous variations of the invention. Therefore, the invention is not limited to the following particular embodied designs, and furthermore, is only to be defined under the provisions of the appended claims and their equivalents.

Figure 1:
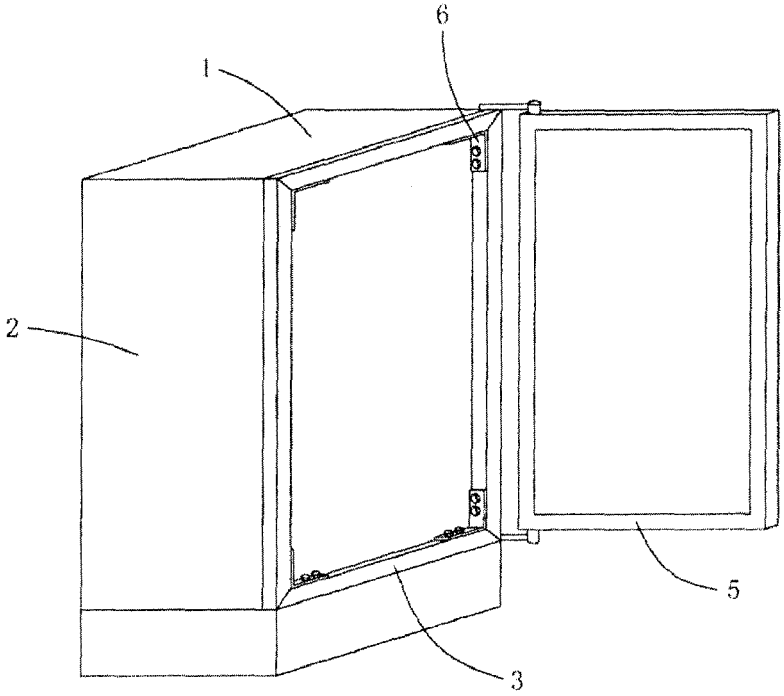
FIG. 1 shows a schematic structural view of a refrigerating apparatus that accords with the invention.

FIG. 1 shows a schematic structural view of a refrigerating apparatus according to a particular implementation of the invention. As can be seen, the refrigerating apparatus comprises a main body 1, side panels 2, a frame 3 and a door body 5; it can be seen that in the refrigerating apparatus, the main body 1, side panels 2, frame 3 and door body 5 enclose a refrigerating chamber used for accommodating items to be refrigerated. Specifically, the side panels 2 are installed on both sides of the main body, the frame 3 is installed on the front side of the main body 1 that aligns opposite with outside edges of the door body and where the frame 3 forms the opening of the refrigerating apparatus used for retrieving and placing items. The door body 5 is installed on the main body 1 and can be rotated about the main body 1 in a manner that it can pivot back and forth so as to allow one to place food items into the refrigerating apparatus or retrieve such items out of the refrigerating apparatus; that is, the door body 5 can be rotated between an open position that allows the main body to be opened and a closed position that allows the main body to be closed.

Figure 2:
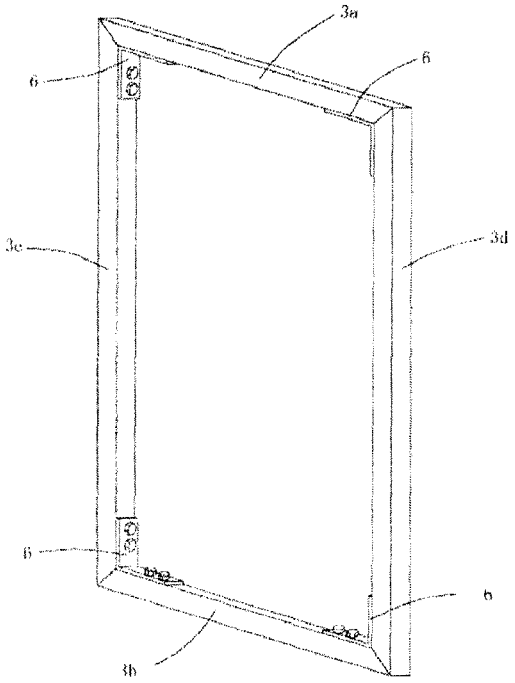
FIG. 2 shows a schematic structural view of a frame of the refrigerating apparatus of FIG. 1.

FIG. 2 further shows a schematic structural view of the frame 3 design depicted in the refrigerating apparatus designs in FIG. 1. While the frame of the refrigerating apparatus in the designs shown in FIGS. 1 and 2 has a square-shaped structure, it should be understood that the refrigerating apparatus outlined for invention can also have other different structures and is not limited to the square-shaped structure design shown in FIG. 1 of the invention. For example, in some structural designs, the frame of the refrigerating apparatus of the invention can also be designed to be of substantially circular, oval shape (among other shapes it may be designed to be as well). In other alternative implementations, a sealing strip is placed between the frame 3 and the door body 5. This sealing strip can be placed on the door body 5 (as shown in FIG. 4) and can also be placed on the frame 3.

As shown in FIG. 2, the frame 3 design comprises an upper component 3*a*, a lower component 3*b*, a left component 3*c* and a right component 3*d*, among which the upper component, the lower component, the left component and the right component are attached to form the rectangular frame. In a preferred scheme, the upper component 3*a*, the lower component 3*b*, the left component 3*c* and the right component 3*d* are attached together by means of the multiple attaching component parts 6 in a detachable manner to form a frame 3; this allows that the frame 3 can be easily disassembled when it is required that maintenance work be performed on the frame 3. As shown in FIGS. 1 to 3 and FIG. 5, the attaching components (e.g., in the form of angle iron blocks having mounting holes) are respectively attached to corresponding components by means of multiple screws. As described above, if the refrigerating apparatus is possibly assembled in circular or oval shape, the frame 3 is also thus accordingly of a circular or oval shape. In this event, the frame 3 can also be formed by one circular or oval shaped component, and it is also possible for two or more components to be attached together in the form of a circular or oval shape. Under this circumstance, the attaching components used in the attachment of two or more components can be of a corresponding suitable structural shape that can be pictured and designed by those skilled in this technical domain and, thus, will not discussed in detail.

Figure 3:
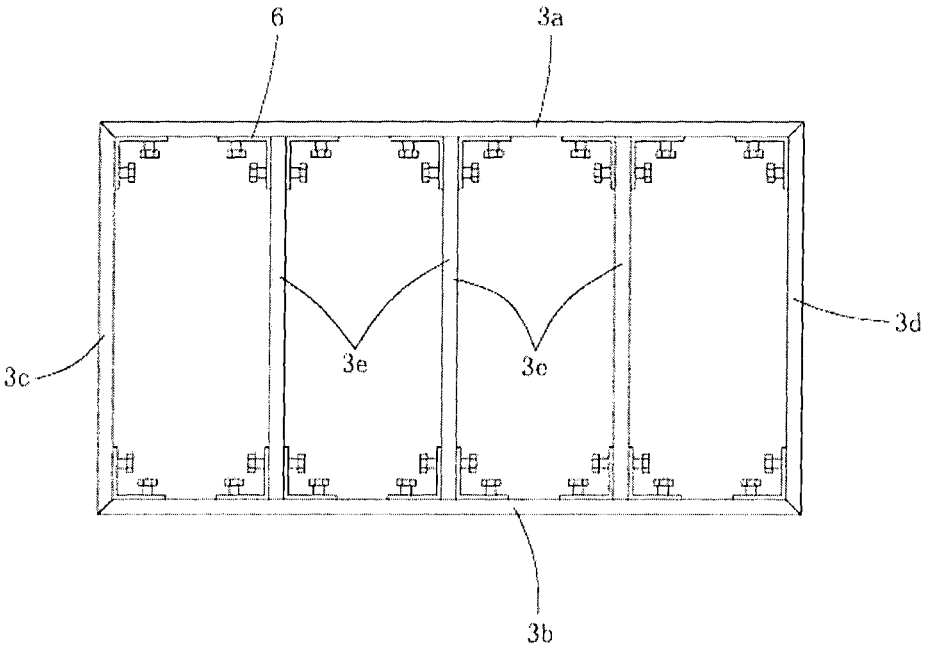
FIG. 3 shows a schematic structural view of a frame of a different refrigerating apparatus.

FIG. 3, in a further step, shows the structure of the frame 3 that corresponds to the refrigerating apparatus in another particular implementation of the invention. The refrigerating apparatus depicted in this particular example displays the use of multiple door bodies so that the refrigerating space of the refrigerating apparatus is divided into multiple different compartment spaces (e.g., refrigerating chambers). In this structure, in addition to the upper component 3*a*, the lower component 3*b*, the left component 3*c* and the right component 3*d*, the frame 3 also comprises at least one intermediate component 3*e* attached to the upper component 3*a* and the lower component 3*b*. Preferably, the at least one intermediate component 3*e* may also be attached to the above-described upper and lower components by means of attaching component 6 parts. It should be understood that in alternate design structures, the at least one intermediate component 3*e* can also be attached to the left component 3*c* and the right component 3*d* rather than the upper component 3*a* and the lower component 3*b*.

Figure 4:
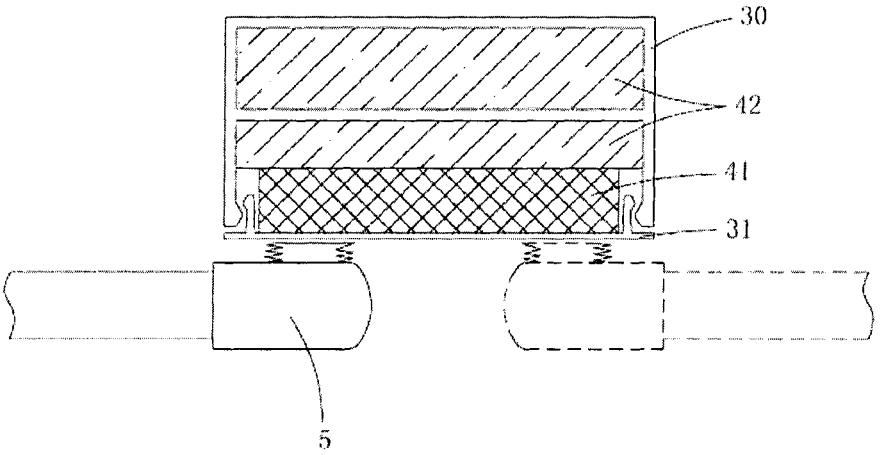
FIG. 4 shows a schematic sectional view of the frame components.
Figure 5:
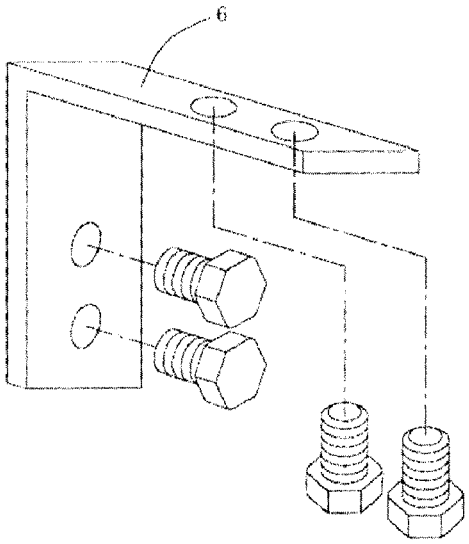
FIG. 5 shows a schematic structural view of the connecting of the frame components shown in FIGS. 1-3.

FIG. 4 shows a schematic structural view of the components of the frame 3. When the refrigerating chamber of the refrigerating apparatus is closed, the door body of the refrigerating apparatus is compressed against the front surface of the components of frame 3. It is recommended that the intermediate component shown in FIG. 4 should be used as the intermediate component 3*e* of FIG. 3, and the corresponding components of two door bodies 5 compress against both sides of the front surface of the intermediate component 3*e* respectively. It should be understood that in the particular example depicted in FIG. 1, as a separate example, the upper component, the lower component, the left component and the right component (e.g., outside edges of the door body) of a single door body can compress against the upper component 3*a*, the lower component 3*b*, the left component 3*c* and the right component 3*d* of the frame respectively.

As shown in FIG. 4, the at least one component of the frame 3 has a VIP material 41 placed inside. Preferably, the VIP material 41 is placed so that it is adjacent to the front surface of the at least one other component from inside the at least one component it is installed in. The VIP material is a kind of vacuum heat preservation material that is formed by packaging glass wool core material characterized by extremely strong insulation characteristics together in a vacuum state with high barrier packaging material. The result exhibits excellent insulation characteristics. The VIP material can effectively avoid heat transfer caused by air convection, and the heat transfer coefficient can therefore be considerably reduced; moreover, the VIP material does not contain any ozone depleting material and has the characteristics of being environmentally protective, efficient and energy saving. Therefore, by means of installing VIP material 41 inside of the at least one frame 3 components, specifically near the front surface of the at least one component, the component will have well-defined heat insulation capability that has the following effect: under the condition that there is frequent opening and closing of the door body, when exterior warmer air makes contact with the front surface of the at least one frame component, condensed water will not be formed on the frame's front surface.

It should be understood that in the most preferable particular implementation of the invention, all the components of the frame 3 should be produced with VIP material inside. Furthermore, it is most preferable that VIP material placed inside of each component be adjacent to the component's front surface.

In further reference to FIG. 4, the at least one design structure composes a component-body part 30 and a component-cover part 31 attached to the body component 30 such that a chamber to hold the VIP material is formed inside the at least one component. Preferably, the component-body part 30 and the component-cover part 31 are attached together in a detachable manner so as to facilitate the placement and removal of the VIP material. In the structure shown in FIG. 4, the component-body part 30 and the component-cover part 31 are attached together by clicking them together. The exterior surface of the component-cover part 31 forms the front surface of the component. As described above, in the invention's preferable implementation, the VIP material is placed inside each component and adjacent to the component-cover part so that the component-cover part 31 has particularly well-defined heat insulation capability, and that hot air moisture will not be prone to condense into water upon making contact with the exterior surface of the component-cover part 31.

As shown in FIG. 4, a foam heat-insulation material 42 can be placed inside of the at least one component. Preferably, the foam heat-insulation material is placed inside of the at least one component and adjacent to that component's rear surface.

It is easily understood that in a preferable particular implementation of the invention, each component of the frame 3 may be structures the same. However, the components of frame 3 can have other structures as long as the VIP material 41 can be easily replaced so as to allow that that when the VIP is damaged, a new VIP can be conveniently used to replace the damaged one. As such, it is ensured that the components of the frame 3 have optimal water condensation prevention capability and are easy to perform service and maintenance upon.

It is further appreciated that with the component structure implementation of the invention, it is no longer required to use an electrical heating function, thus lowering energy consumption.

The invention claimed is:

1. A frame to be installed on a front side of a main body of a refrigerating apparatus, the frame comprising frame components including an upper component, a lower component, a left component and a right component, among which, the upper component and the lower component are attached to the left component and the right component respectively so as to form a rectangular frame, wherein a vacuum insulation panel material is placed inside of at least one of the frame components, the vacuum insulation panel material comprising a core, the vacuum insulation panel material formed by packaging glass wool core material having insulation characteristics together in a vacuum state with a high barrier packaging material.

2. The frame of claim 1, wherein the vacuum insulation panel material is placed inside of the at least one of the frame components and adjacent to a front surface of the at least one of the frame components.

3. The frame of claim 1, wherein the at least one of the frame components comprises a component-body part and a component-cover part that is attached to the component-body part, the component-body part and the component-cover part together form a chamber that holds the vacuum insulation panel material.

4. The frame of claim 1, wherein a foam heat-insulation material is further placed inside the at least one of the frame components.

5. The frame of claim 4, wherein the foam heat-insulation material is placed inside of the at least one of the frame components and adjacent to a rear surface of the at least one of the frame components.

6. The frame of claim 1, wherein the frame is formed as an opening to the refrigerating apparatus that is used for retrieving and placing items to be refrigerated.

7. The frame of claim 1, wherein the upper component, the lower component, the left component and the right component each comprise a component-body part and a component-cover part attached to the component-body part, the component-body part and the component-cover part together form a chamber that holds the vacuum insulation panel material.

8. The frame of claim 1, wherein the upper component, the lower component, the left component and the right component have the same structure.

9. The frame of claim 1, wherein the upper component, the lower component, the left component and the right component are attached in a detachable manner by multiple attaching components in order to form the frame.

10. A refrigerating apparatus that uses the frame of claim 1.

11. The refrigerating apparatus of claim 10, wherein the refrigerating apparatus further comprises a main body and a door body, among which the frame is installed on the front side of the main body, and the door body is installed on the main body and can be rotated between an open position for opening the refrigerating apparatus and a closed position for closing the refrigerating apparatus in a manner that allows the door body to pivot back and forth.

12. A frame to be installed on a front side of a main body of a refrigerating apparatus, the frame comprising frame components including an upper component, a lower component, a left component and a right component, among which, the upper component and the lower component are attached to the left component and the right component respectively so as to form a rectangular frame, wherein a vacuum insulation panel material is placed inside of at least one of the frame components, the vacuum insulation panel material comprising a core, the vacuum insulation panel material formed by packaging glass wool core material having insulation characteristics together in a vacuum state with a high barrier packaging material;

wherein the at least one of the frame components comprises a component-body part and a component-cover part that is attached to the component-body part, the component-body part and the component-cover part together form a chamber that holds the vacuum insulation panel material;

wherein the component-body part and the component-cover part are attached together in a detachable manner.

13. A frame to be installed on a front side of a main body of a refrigerating apparatus, the frame comprising frame components including an upper component, a lower component, a left component and a right component, among which, the upper component and the lower component are attached to the left component and the right component respectively so as to form a rectangular frame, wherein a vacuum insulation panel material is placed inside of at least one of the frame components, the vacuum insulation panel material comprising a core, the vacuum insulation panel material formed by packaging glass wool core material having insulation characteristics together in a vacuum state with a high barrier packaging material;

wherein the frame further comprises at least one intermediate component attached to the upper component and the lower component respectively or attached to the left component and the right component respectively.

14. The frame of claim 13, wherein the at least one intermediate component is attached to the upper component and the lower component or attached to the left component and the right component in a detachable manner.

15. The frame of claim 13, wherein a further vacuum insulation panel material is placed inside of the at least one intermediate component.

16. The frame of claim 15, wherein the further vacuum insulation panel material is placed inside of the at least one intermediate component adjacent a front surface of the at least one intermediate component.

17. The frame of claim 13, wherein the at least one intermediate component has the same structure as the upper component, the lower component, the left component and the right component.

18. The frame of claim 13, wherein the frame forms an opening to the refrigerating apparatus that is used for retrieving and placing items to be refrigerated.

* * * * *